United States Patent [19]

Jay

[11] 4,426,011

[45] Jan. 17, 1984

[54] MODULAR CANTILEVER RACK

[75] Inventor: Richard S. Jay, Niles, Ill.

[73] Assignee: Jarke Corporation, Niles, Ill.

[21] Appl. No.: 243,086

[22] Filed: Mar. 12, 1981

[51] Int. Cl.[3] ..... A47F 5/00

[52] U.S. Cl. ..... 211/193; 211/182

[58] Field of Search ..... 211/193, 189, 182, 191, 211/208, 186; 108/108; 52/657, 695

[56] References Cited

U.S. PATENT DOCUMENTS

| | | | |
|---|---|---|---|
| 862,973 | 8/1907 | Kahn | 52/695 |
| 1,698,974 | 1/1929 | Vance | 211/193 X |
| 3,155,202 | 11/1964 | Milette | 52/695 X |
| 3,512,654 | 5/1970 | Olsen et al. | 248/243 X |
| 3,602,374 | 8/1971 | Alabasta | 211/193 |
| 3,698,566 | 10/1972 | D'Altrui | 211/193 |
| 3,827,377 | 8/1974 | Aughtry | 211/193 X |
| 3,913,498 | 10/1975 | Hall et al. | 211/193 X |
| 3,918,590 | 11/1975 | D'Altrui | 211/193 |

*Primary Examiner*—Ramon S. Britts
*Assistant Examiner*—Robert W. Gibson, Jr.
*Attorney, Agent, or Firm*—Basil E. Demeur; Robert E. Knechtel

[57] ABSTRACT

The present invention provides an improved modular cantilever rack formed by an improved base assembly for interconnecting the vertical support members to the base assemblies. The present improved rack also provides an improved bracing system formed by at least one pair of V-shaped brace members. Also provided is an improved carrying arm assembly such that each carrying arm is provided with an arm end cap adapted to be pivotally movable between a flush rest position, and an extended stop position.

8 Claims, 5 Drawing Figures

FIG. 1
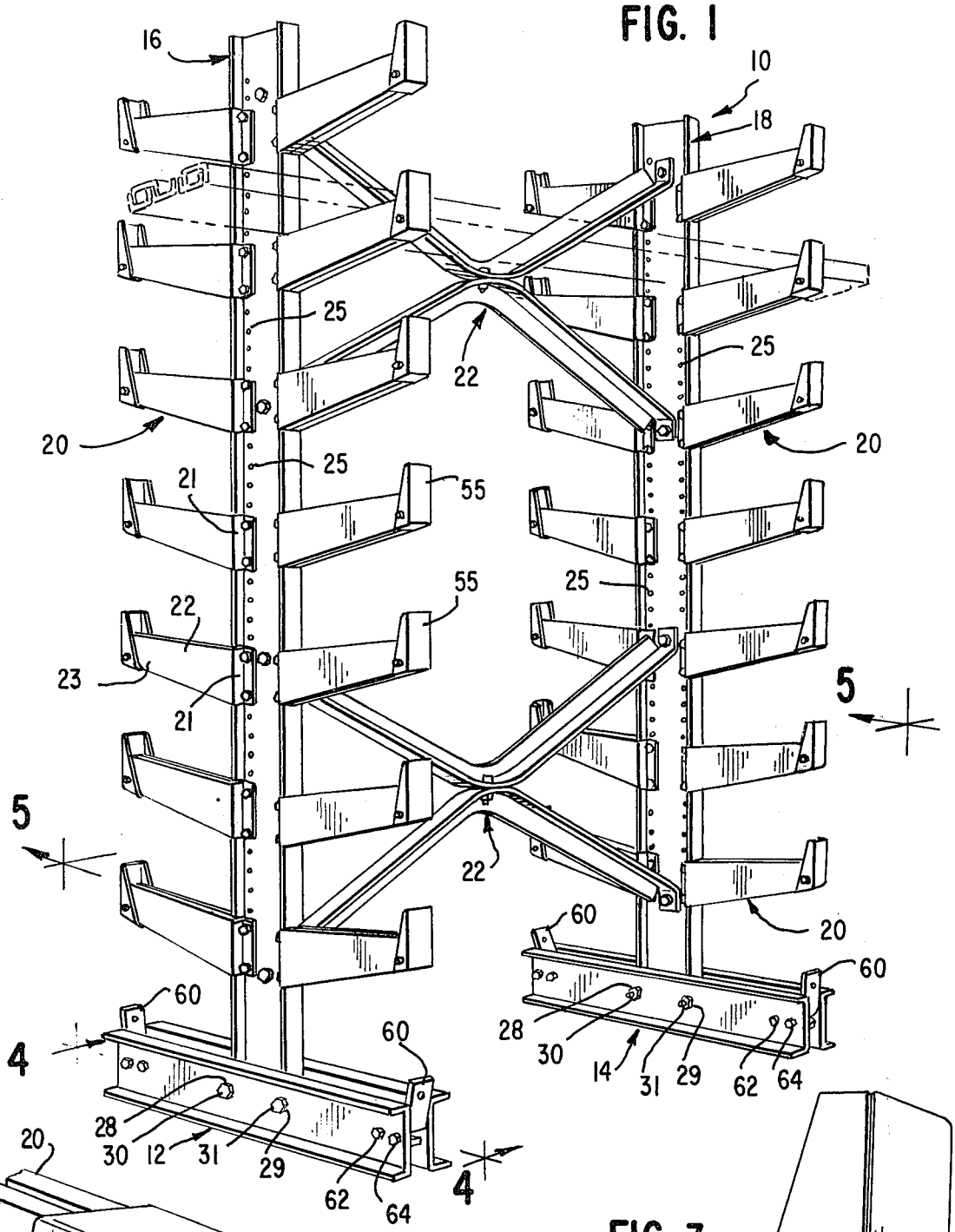
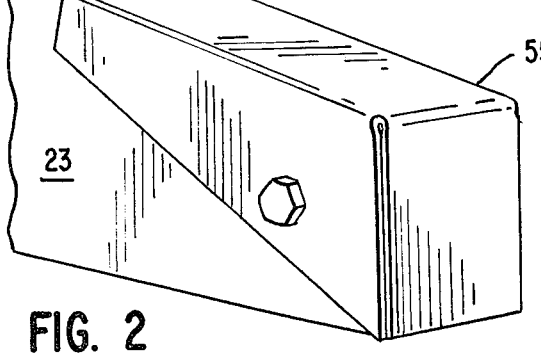
FIG. 2
FIG. 3
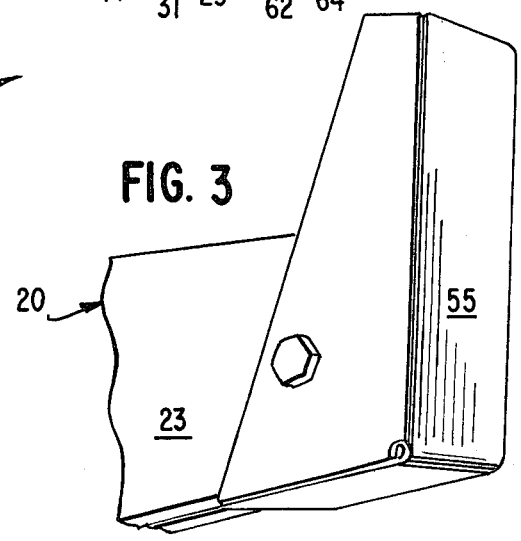

FIG. 4
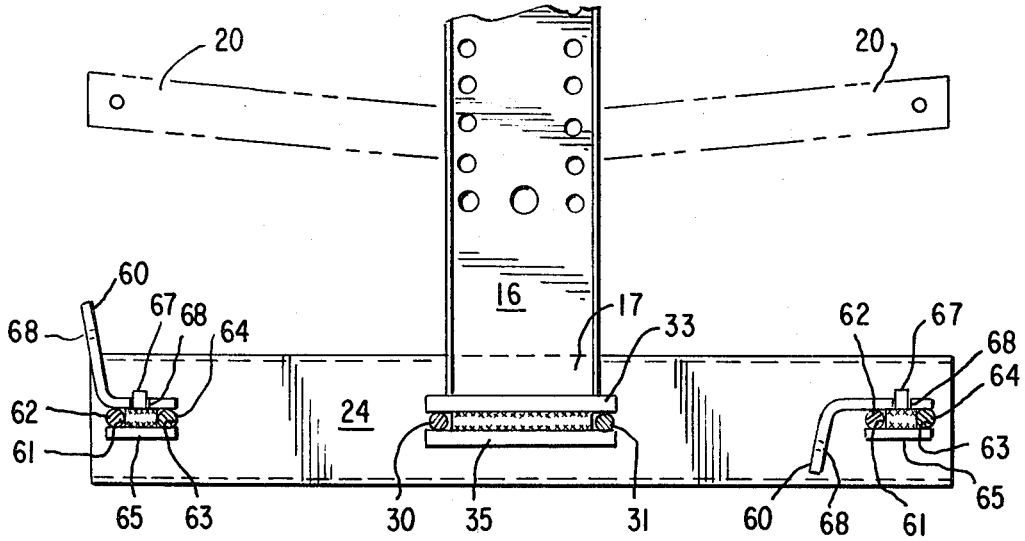
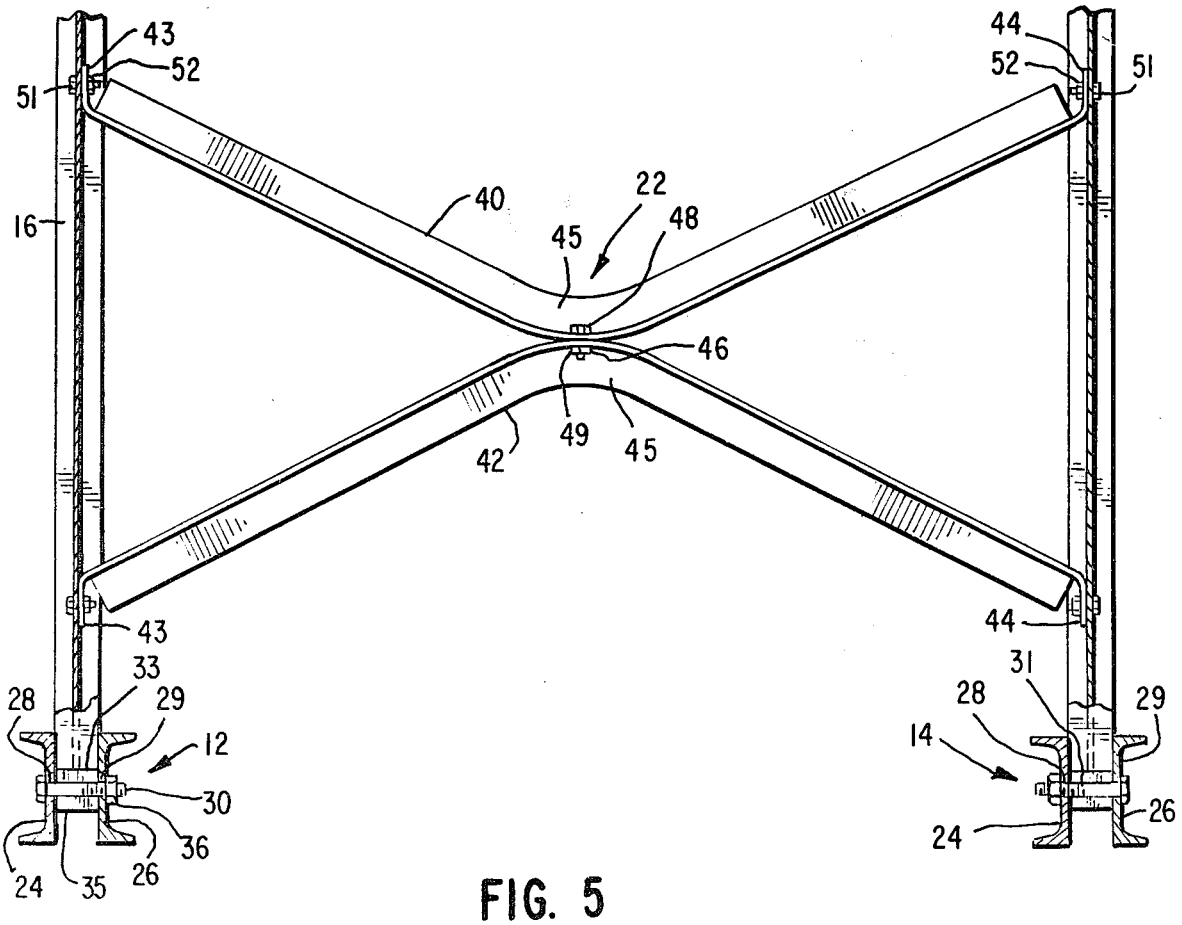
FIG. 5

MODULAR CANTILEVER RACK

BACKGROUND OF THE INVENTION

This invention relates to an improved cantilever rack assembly of the type adapted to carry a plurality of articles or loads on carrying arms which are in turn mounted on a vertical support member forming a portion of the rack.

Typically, cantilever racks are well-known in the art, and are usually formed from a base assembly designed and adapted to carry at least a pair of vertical support members upstanding therefrom, the vertical support members then being provided with a plurality of both vertically and horizontally aligned carrying arms such that articles such as tubes, pipes, or other elongated articles may be positioned and carried between correspondingly opposed arms mounted on the rack. Assemblies of this type are typically shown in prior art patents such as U.S. Pat. No. 1,698,974, wherein a cantilever bar rack is shown to be formed by a base assembly carrying, in this instance, three vertical support members, which in turn are provided with a plurality of carrying arms mounted thereon. It will also be noted that the vertical support members are braced one to the other by means of a pair of brace rods denoted by the numeral "24", typically for the purpose of preventing swaying of the rack during its load configuration. It will also be noted in the aforementioned patent that each of the carrying arms is provided with an upstanding end piece thereby to prevent loads carried on the arms from spilling over the end thereof.

Another example of a cantilever rack is shown by applicant's prior U.S. Pat. No. 3,512,654, which again shows a cantilever rack formed by a pair of base members carrying opposed vertical support members, and each of the support members in turn having a plurality of cantilever carrying arms mounted thereon. It will be noted that the vertical support members are interconnected by brace members, which in this case, are in the form of horizontally aligned support bars interposed therebetween to add stability and anti-swaying features to the subject rack.

Still other examples of cantilever racks showing various locking features and the like are shown in U.S. Pat. No. 3,602,374, which is shown to accommodate carrying arms designed for movable positioning along the length of the corresponding vertical support members.

Still another example of a rack assembly of the type similar to various other of the prior art racks is shown in U.S. Pat. No. 3,827,377, wherein the base assembly is shown to be formed by a pair of C-shaped channel members having a vertical support member interposed therebetween and fixedly secured by means not recited therein.

Typically, the vertical support members are carried on the base by welding, as, for example, shown in U.S. Pat. No. 4,065,089. Alternatively, the vertical support members may be fixedly secured to the base members by means of a bolt arrangement as is shown in U.S. Pat. No. 3,698,566.

It has been found that in many of the prior art rack assemblies, while various attempts have been made at securing the vertical support members to the bases as selected by the manufacturers thereof, nevertheless, it has been found that many of these racks still suffer from swaying characteristics when an extremely load is placed thereon. Similarly, the bracing systems which have heretofor been provided have generally been of the diagonal type, such as shown in U.S. Pat. No. 1,698,974, wherein the brace members are straight rods diagonally opposed from end-to-end as between the corresponding vertical support members, or have been in the form as shown in U.S. Pat. No. 3,512,654. As shown therein, a brace system is shown to be formed by horizontally aligned braces interposed between opposed vertical support members. However, it has been found that bracing systems of either type still do not prevent swaying under extreme load conditions, and therefore, it has been deemed desirable to develop further improvements to further improve the stability and anti-swaying characteristics of such cantilever racks given the fact that such racks often carry extremely heavy loads.

It has further been deemed desirable to improve upon the end cap features of the carrying arms, such that the carrying arms may be altered to provide a flush disposition from end to end. This may be desirable where the carrying arms are intended to carry squared-off tubular materials such as square-shaped tubes and the like, wherein it is not considered likely that such materials will roll off of the carrying arms.

OBJECTS AND ADVANTAGES

It is therefore considered to be a principal object of this invention to provide an improved modular cantilever rack which has an improved base assembly for interconnecting the vertical support members to the base assemblies thereof, such that a greater degree of stability and anti-swaying characteristics are achieved. Further improvements in the subject rack are contemplated by providing the carrying arms with pivotally movable arm end caps such that the end caps will present the carrying arms with a flush position as well as with a stop position, and also to provide the base assemblies with similarly movable base stop members movable between a flush position and a stop position.

In conjunction with the foregoing object, it is an object of this invention to provide an improved modular cantilever rack wherein there is provided an improved base member assembly formed by a pair of spaced apart C-shaped channel members positioned in back-to-back relationship each having a pair of horizontally aligned carrying apertures positioned therein, the vertical support members being formed from an I-beam and having a lower support portion and an upper carrying portion, the lower support portion of the I-beam support member being positioned between the pair of C-shaped channel members and having a pair of lamellar support bars mounted adjacent the lower end thereof and positioned in spaced apart horizontal relationship one to the other, the carrying apertures and the C-shaped channel base members being aligned between the spaced apart lamellar support bars, and a pair of tubular bars carried through the carrying apertures of the C-shaped channel base members and positioned between the pair of spaced apart lamellar bars thereby to secure the vertical support member to the pair of C-shaped channel base members in a secure manner and in a manner to prevent joint rotation therebetween.

In conjunction with the foregoing object, it is yet a further object to provide an improved rack of the type described wherein the spacing between the lamellar support bars is slightly greater than the outside diameter of the tubular bars such that close tolerances are provided between the tubular bars and the spaced apart lamellar support bars to minimize joint rotation.

Still a further object of the present invention is to provide an improved modular cantilever rack of the type described wherein there is provided an improved brace assembly formed by at least one pair of V-shaped brace members, each of the V-shaped brace members formed as a single element having a pair of outer support connecting flanges and a central V-shaped connecting portion, the V-shaped connecting portion having a bolt aperture positioned therein, the pair of V-shaped base members being positioned in inverted relation one to the other, thereby to assume an overall X-shaped support configuration, and a pair of V-shaped brace members being interconnected to one another by a bolt inserted through the bolt apertures of the corresponding V-shaped brace members, and to corresponding apertured vertical support members by bolts positioned through the bolt apertures in the connecting flanges and through apertures provided in the apertured vertical support members.

Still another object of this invention is to provide an improved modular cantilever storage rack of the type described which is provided with a plurality of improved carrying arms, each of the carrying arms having a mount end for mounting to a corresponding vertical support member and an outer carrying end, the outer carrying end provided with an arm end cap pivotally mounted thereon and being pivotal in a closed flush position relative to the carrying arm, and an extended stop position relative to the carrying arm.

Still further object of the present invention is to provide an improved modular cantilever rack of the type described wherein the C-shaped channel base members are further provided with a pair of base stop support means mounted at the opposed ends thereof, and further provided with a base stop member removably carried by the base support means such that the base stop member is alternately movable from a rest position thereby to present a flush base surface, to an extended stop position thereby to present a stop position in order to retain a load carried on the C-shaped channel base members.

Further objects of the invention will be evident from the description of the invention taken in conjunction with the accompanying drawings. The invention, both as to its method and mode of operation, together with further objects and advantages, will therefore be best understood by reference to the following specification.

BRIEF DESCRIPTION OF DRAWINGS

FIG. 1 is a plan view showing the improved modular storage rack of the present invention in its fully assembled configuration;

FIG. 2 is a perspective view, partly broken away, showing the end portion of a carrying arm and having the arm and cap in the rest position such that the carrying arm presents a flush surface;

FIG. 3 is a perspective view, partly broken away, of the end of a carrying arm showing the arm end cap in its extended stop position thereby to retain a load thereon;

FIG. 4 is a cross-sectional view, partly broken away, taken in the direction of the arrows along the line 4—4 of FIG. 1, showing the details of the improved base assembly, and the mode of attachment of the vertical support members thereto; and FIG. 5 is a side elevational cross-sectional view taken in the direction of the arrows along the line 5—5 of FIG. 1, showing the details of construction of the improved bracing assembly of the rack of the present invention.

SUMMARY OF THE INVENTION

In summary, the present invention provides an improved modular cantilever rack, to the extent that the rack is improved by an improved base assembly for mounting the vertical support members thereto, such that the rack presents a more secure construction and provides additional anti-swaying characteristics. The improvement resides in the interconnection of the vertical support member to the pair of C-shaped channel base members by the inclusion of a pair of lammelar horizontally mounted support bar adjacent the end of the vertical support bar in conjunction with a pair of horizontally aligned carrying apertures positioned through the base channel members, the assembly being completed by a pair of a tubular bolts or threaded bolts positioned through the carrying apertures and interposed between the spaced apart lamellar support bars and tightened into position such that the vertical support members are securely held as between the C-shaped base channel members.

The invention further provides an improved carrying arm assembly to the extent that the carrying arms are provided with a pivotally mounted arm end cap pivotal between a flush rest position, and an extended stop position.

Finally, the invention provides an improved rack to the extent that the base channel members are provided with movable base stop members, alternately movable between a flush rest position, and an extended stop position, in a manner similar to the arm end caps described hereinabove.

DETAILED DESCRIPTION OF INVENTION

As particularly shown in FIGS. 1, 4 and 5, the improvements of the modular cantilever rack of the present invention relate to the base assemblies as illustrated. It will be observed that the cantilever rack, generally referred to by the numeral 10, is shown to be formed by the pair of opposed base assemblies denoted by the numerals 12 and 14. Fixedly secured to each of the base assemblies 12 and 14 respectively is a vertical support members 16 and 18 respectively. Each of the vertical support members 16 and 18 respectively are shown to carry a plurality of carrying arms denoted by the numeral 20 which are fixedly secured to the respective support members 16–18 by an interior connecting portion 21, and also shown to include an outer carrying portion 23.

The vertical support members 16 and 18 are shown to be retained in a spaced-apart and secure position by means of a pair of brace assemblies 22, which, when in the assembled position, assume an overall X-shaped configuration.

With particular reference to FIG. 4 of the drawings, the improved base assembly of the present invention is illustrated. It will be observed that the C-shaped channel members 24 and 26 respectively are each provided with carrying apertures 28 and 29, respectively, (FIG. 1) which are designed and adapted to carry a pair of bolts 30 and 31, respectively, therethrough. As shown in FIG. 4, the vertical support member 16 includes a lower portion 17 thereof which is positioned between the pair of C-shaped channel members 24 and 26 respectively. The lower portion 17 of the vertical support member 16 includes a pair of lamellar support bars 33 and 35 respectively which are welded thereto in vertically spaced horizontal planes one with respect to the other. The positioning of the lamellar support bars 33 and 35 is such that when the vertical support member 16 is in position in between the respective C-shaped channel members 24 and 26, the carrying apertures 28 and 29 are aligned in between the spaced apart position as between the lamellar support bars 33 and 35. It will therefore be apparent that when the threaded bolts 30 and 31 are inserted through the carrying apertures 28 and 29 of the C-shaped channel members 24 and 26 respectively, the same will be positioned in the spaced apart area between the pair of lamellar bars 33 and 35. The bolts are held in position by means of threaded nuts 36 and 37 respectively (see FIG. 5) and it will therefore be apparent that when the threaded nut 36 is tightened onto the bolt 30, the C-shaped channel members 24 and 26 are drawn together with the vertical support member 16 interposed therebetween. The lamellar support bars 33 and 35 function to not only retain the vertical support bar 16 in its upstanding position, but it will be apparent from FIG. 4 of the drawings that joint rotation is prevented. It is also considered to be a feature of the present invention that the spacing between the lamellar support bars 33 and 35 is adjusted to be just slightly greater than the outside diameter of the bolts 30 and 31, such that there are very close tolerances therebetween. Hence, upon the tightening of the threaded nut 36 onto the bolt 30, a very secure arrangement is achieved as between the vertical support member 16, and the C-shaped channel member 24.

With reference to FIG. 5 of the drawings, the improved brace assembly of the present invention is illustrated. It will be observed that a brace assembly 22 is generally formed by a pair of V-shaped brace members 40 and 42 respectively, which are constructed identically. For ease of reference, reference will be made to the V-shaped brace member 40. With respect to the V-shaped brace member 40, it will be observed that it is formed with a pair of outer connecting flanges 43 and 44 respectively, positioned at the outer ends thereof, and with a central connecting portion 45 at the approximate mid position thereof. The central connecting portion 45 includes a bolt aperture 46 positioned in the mid position thereof, and hence, when a pair of V-shaped brace members 40 and 42 are constructed in their bracing position, they are held together by means of a threaded bolt 48, held in position by a threaded nut 49.

The outer connecting flanges 43 and 44 respectively are secured to the vertical support members 16 and 18, respectively, by means of a threaded bolt 51 which is inserted through an appropriate aperture contained in the vertical support member 16 or 18, and through an aperture provided in the outer connecting flange 43 or 44. The bolt 51 is held in position, once again, by a threaded nut.

With reference to the vertical support members 16 and 18, it will be observed that each of the vertical support members 16 and 18 includes a plurality of linearly aligned apertures denoted by the numeral 25 (see FIG. 1) along the length thereof, for the purpose of providing a convenient mounting position for the carrying arms 20 as well as for the brace assemblies 22. In this manner, the carrying arms 20, as well as the brace assemblies 22, may be positioned along virtually any position of the vertical support members 16 and 18 as may be deemed necessary or desirable.

With regard to the bracing assembly 22 described hereinabove, it will be apparent that by providing a V-shaped brace member 22 in the manner described, a pair of brace members may then be mounted together to assume an overall X-shaped configuration, which achieves the advantages of both the horizontal brace systems heretofore described, as well as the diagonal brace systems also described hereinabove. However, it has been found that by providing an overall X-shaped configuration, a greater degree of stability may be achieved with the attendant benefit that less swaying of the rack will be observed during its loaded posture.

With reference to FIGS. 1, 2 and 3 of the drawings, the improved features of the carrying arm 20 are illustrated. It will be observed that each carrying arm 20 includes an outer carrying portion 23 which has, at the outer end thereof, an arm end cap 55 pivotally mounted thereon. The pivotal mounting of the arm end cap 55 is achieved by means of a threaded bolt inserted through appropriate apertures provided in the outer carrying portion 23 of the carrying arm 20, and in the arm end cap 55. As shown in FIG. 2 of the drawings, the arm end cap 55 may be lowered to a rest position which is essentially flush with the carrying arm 20, and hence provide a smooth surface for flat surfaced materials. Alternatively, the arm end cap 55 may be extended to its stop position as shown in FIG. 3 of the drawings, and thereby act as a stop boss or stop member for any rounded tubular loads carried thereon. It is therefore submitted that the improvement to the carrying arms permits a greater degree of flexibility of the subject carrying arm regardless of the load carried thereon.

With respect to FIG. 4 of the drawings, it will be observed that the C-shaped channel members 24 and 26 respectively are also provided with movable base stop members 60. Each of the base stop members 60 and the corresponding structure are identical, and therefore, reference will be made only to one of the assemblies. It will be understood, however, that the description applies equally to each side of each of the C-shaped channel members 24 and 26 respectively.

Again, with reference to FIG. 4, it will be observed that the C-shaped channel members 24 and 26 are each provided with a pair of base apertures 61 and 63, respectively, through which a pair of base stop support bars 62 and 64 are carried. If desired, the base stop support bars 62 and 64 may be provided in the form of threaded bolts retained in position by nuts, in the manner generally depicted in FIG. 1 of the drawings. A carrying plate 65 is shown to be secured by wall nuts or other suitable means between the base stop support bars 62 and 64, and a stop pin 67 is carried by the carrying plate 65. The stop pin 67 extends upwardly a short distance from the carrying plate 65, and is designed to coact with the base stop member 60 in the manner described herein below.

The base stop member 60 is shown to be an essentially L-shaped element wherein the angle of the L is slightly obtuse, and wherein each leg of the L-shaped element includes a stop aperture 68. It will be apparent, therefore, from FIG. 4 of the drawings, that the base stop member may be positionally mounted on the carrying plate 65 by inserting the stop pin 67 through a stop aperture 68 in one of the legs of the base stop member 60 depending upon whether the stop position is desired (as shown in one version of the position of the stop member 60 in FIG. 4, or a rest position is desired as shown in the opposed view of the base stop member 60 mounted on the C-shaped channel member 24.

It will be apparent from the above description, that pursuant to the present invention, an improved modular cantilever rack has been provided in that the base assembly has been designed to more securely retain the vertical support members in a rigid and upstanding position thereby to further secure the vertical support members and to further prevent any swaying of the rack when in use. In addition, the improved end caps for the carrying arms provides some degree of flexibility heretofore unachievable with respect to such racks since the arm end caps are movable from a flush position to a stop position by a simple pivotal action. Similarly, the opposed base assemblies 12 and 14 are also provided with movable stop members such that the stop members may also be alternately moved from a flush rest position, to an extended stop position.

While there has been described what is at present to be the preferred embodiment of the invention, it will be understood from the above description that various modifications may be made therein without the departing from the true spirit and scope of the invention. It is intended to cover in the intended claims all such obvious modifications of the present invention.

I claim:

1. In a modular cantilever rack of the type having at least a pair of spaced apart base members, each base member having an apertured vertical support member upstanding therefrom, said vertical support members having brace members interposed therebetween, and said respective vertical accommodating at least one carrying arm mounted thereon and extending outwardly therefrom, the improvement comprising, in combination, an improved base member assembly formed by a pair of spaced apart C-shaped channel members positioned in back-to-back relationship each having a pair of horizontally aligned carrying apertures positioned therein, each of said vertical support members being formed from an I-beam and having a lower support portion and an upper carrying portion, said lower support portion of said I-beam support member being positioned between said pair of C-shaped channel members and having a pair of lamellar support bars mounted adjacent the lower end thereof and positioned in vertically spaced horizontal planes one to the other, said carrying apertures on said C-shaped channel base members being aligned between said vertically spaced apart lamellar support bars, and a pair of tubular bars carried through said carrying apertures on said C-shaped channel base members and positioned between said pair of vertically spaced apart lamellar bars thereby to secure said vertical support member to said pair of C-shaped channel base members and prevent joint rotation therebetween.

2. The improved modular cantilever rack as set forth in claim 1 above, wherein said lamellar support bars are spaced apart a distance slightly greater than the outside diameter of said tubular bars thereby to provide close tolerances as between said tubular bars and said spaced apart lamellar support bars.

3. The improved modular cantilever rack as set forth in claim 2 above, wherein said tubular bars comprise a pair of threaded bolts positioned through said carrying apertures of said C-shaped channel base members thereby to provide continuous tightening characteristics to effect a secure a relationship as between said vertical support member and the corresponding base member assembly.

4. The improved cantilever rack as set forth in claim 1 above which further includes an improved brace assembly comprising, at least one pair of V-shaped brace members, each of said V-shaped brace members being formed as a single element having a pair of outer support connecting flanges and a central V-shaped connecting portion, each of said V-shaped connecting portions having a bolt aperture positioned therein, said pair of V-shaped brace members being positioned in inverted relation one to the other thereby to assume an overall X-shaped support configuration, and said pair of V-shaped brace members being interconnected to one another by a bolt inserted through said bolt apertures and to the corresponding apertured vertical support members by bolts through said bolt apertures in said connecting flanges and through apertures provided in said apertured vertical support members, whereby said pair of inverted V-shaped brace member assemblies may be interposed between opposed vertical support members and bolted into position to form a bracing system for said modular cantilever rack.

5. The improved modular cantilever rack as set forth in claim 2 above, wherein each of said V-shaped brace members is formed from an unitary L-shaped channel member.

6. The improved modular cantilever rack as set forth in claim 1 above, which further includes a plurality of improved carrying arms, each of said carrying arms having a mount end for mounting to a corresponding vertical support member, and an outer carrying end, said outer carrying end provided with an arm end cap pivotally mounted thereon and being pivotal between a closed flush position relative to said carrying arm in an extended stop position relative to said carrying arm, whereby said arm may be alternately moved between a flush rest position relative to said carrying arm, and an extended stop position, relative to said carrying arm.

7. The improved modular cantilever rack as set forth in claim 1 above, wherein each of said C-shaped channel base members is further provided with a pair of base stop support means mounted at the opposed ends thereof, and said C-shaped channel base members are further provided with a base stop member removably carried by said base stop support means, said base stop member being alternately movable from a rest position thereby to present a flush base surface to an extended stop position thereby to permit the retention of a load carried on said C-shaped channel base members.

8. The improved modular cantilever rack as set forth in claim 7 above, wherein said base stop support means each comprises a pair of horizontally aligned support bars mounted between said adjacent C-shaped base channel members, adjacent the outer end thereof, a carrying plate fixedly secured between said C-shaped channel members and positioned between said pair of horizontally aligned support bars, said carrying plate having a support pin mounted thereon and extending upwardly therefrom for a short distance, and wherein said base stop member is formed in a obtuse angle L-shaped configuration, each leg of said L-shaped configuration having a support aperture positioned therein, whereby said base stop member may be positioned on said carrying plate by inserting said stop pin through said corresponding aperture thereby to alternately mount and dismount said base stop member in a flush rest position and a stop extended position.

* * * * *